US005733203A

United States Patent [19]

Middleton

[11] Patent Number: 5,733,203

[45] Date of Patent: Mar. 31, 1998

[54] GOLF CLUB

[76] Inventor: Nicholas Middleton, 144 Meadowhead, Sheffield S8 7UF, United Kingdom

[21] Appl. No.: 652,436

[22] PCT Filed: Dec. 8, 1994

[86] PCT No.: PCT/GB94/02686

§ 371 Date: Aug. 16, 1996

§ 102(e) Date: Aug. 16, 1996

[87] PCT Pub. No.: WO95/15791

PCT Pub. Date: Jun. 15, 1995

[30] Foreign Application Priority Data

Dec. 9, 1993 [GB] United Kingdom ..... 9325232
Sep. 22, 1994 [GB] United Kingdom ..... 9419093

[51] Int. Cl.[6] ..... A63B 53/02; A63B 53/06; A63B 53/16

[52] U.S. Cl. ..... 473/248; 473/296; 473/313; 473/340; 473/314; 473/307; 473/319; 273/DIG. 23

[58] Field of Search ..... 473/305, 304, 473/307, 313, 314, 322, 340, 296, 246, 247, 248, 288, 319; 273/DIG. 23

[56] References Cited

U.S. PATENT DOCUMENTS

| | | | |
|---|---|---|---|
| 2,222,534 | 11/1940 | Harris | 473/248 |
| 2,932,515 | 4/1960 | May | 473/248 |
| 4,411,429 | 10/1983 | Drew | 473/313 |
| 4,519,612 | 5/1985 | Tsao | 473/248 |
| 4,702,477 | 10/1987 | Solomon | 473/313 |
| 5,452,891 | 9/1995 | Thomas | 473/296 |
| 5,520,392 | 5/1996 | Foresi | 473/227 |

FOREIGN PATENT DOCUMENTS

| | | | |
|---|---|---|---|
| 1222263 | 5/1987 | Canada | 273/80.1 |

*Primary Examiner*—Sebastiano Passaniti
*Assistant Examiner*—Stephen L. Blau
*Attorney, Agent, or Firm*—Trexler, Bushnell, Giangiorgi & Blackstone, Ltd.

[57] ABSTRACT

Disclosed is a golf club comprising a shaft having a longitudinal axis. On the shaft is a hosel, and a head is securable on the hosel. When the head is secured on the hosel it may be used to strike a golf ball. The head is slidably adjustable along at least a portion of the hosel to a selected distance from the longitudinal axis of the shaft. Preferably, the selected distance may be greater than the diameter of the golf ball.

15 Claims, 2 Drawing Sheets

2
1
4
3
8
3
A
6
5
7

2
1
4
3
8
3
6
5
7

GOLF CLUB

BACKGROUND OF THE INVENTION

This invention relates to golf clubs and is particularly concerned with a golf putter.

Traditionally golf putters, in common with other golf clubs, have a head secured to a shaft with the head in fixed angular relationship to the shaft. With some putters, the head is in alignment with the shaft, and with others, the head is offset from the shaft to a degree such that with the face of the head positioned directly behind a ball, the axis of the shaft is substantially in alignment with the centre of the ball. For the most part, putter heads are designed to provide a so-called "sweet spot", on the presumption that if the ball is struck by the sweet spot on the head, considerable feel and control is provided over the propelling of the ball in the required direction and over the required length.

There is the reality that most golfers are not sufficiently expert to guarantee striking the ball with the sweet spot, and the presence or the absence of a sweet spot has no particular effect on the degree to which the ball is propelled.

Also, positioning the club with the shaft aligned with the ball centre runs the major risk of unintentional contact between the club head and the ball and the loss of a stroke.

With a putter head in fixed relationship with the shaft, no account is taken of the different statures and different preferences of golfers, and no ability to vary the configuration of the club to allow a golfer to find a configuration that best suits him or her.

SUMMARY OF THE INVENTION

The object of the present invention is to provide a golf putter that assists in overcoming those disadvantages mentioned above.

According to the present invention, a golf club putter comprises a shaft, an offset hosel on the shaft of a length greater than the diameter of a golf ball, and a head secured on the offset hosel. The hosel may be a straight hosel lying at 90° to the axis of the shaft, and, preferably, the head is adjustably secured on the hosel and further preferably, the head has a shape and mass such that it has no sweet spot. Alternatively, the hosel may be a cranked hosel for direct attachment to a golf club head.

The length of the shaft may be relatively conventional, but equally the shaft could be of a length such that with a head on the shaft in proximity to the ground, the free end of the shaft can be gripped in the armpit of the golfer. As a further alternative, a shaft of adjustable length may be provided e.g. telescopic, to provide a first relatively conventional length and a second extended length. A still further alternative is to provide a shaft of relatively conventional length and an extension piece that can be secured to the shaft to provide the longer length to extend to the armpit of the user.

According to a further aspect of the present invention, a golf putter comprises a shaft of a length commensurate with the height of the golfer and whereby the free end of the golf club shaft can be gripped in the armpit of the golfer and the golf club head positioned behind a ball with the golfer in a generally upright disposition, the connection between the golf club head and the shaft being by way of an offset hosel, the length and the height of which is greater than the diameter of the ball, the golf club head being secured to the hosel.

Thus, the head may be angularly adjustable on the hosel to lie at a required obtuse angle to the axis of the shaft, lying to the opposite side of the shaft to the position of the golfer, and the head can be rotated on the shaft from a position where the putter is for right-hand use, to a position where it is for left-hand use. Equally, the head can be rotated about the hosel to a position where it lies at an acute angle to the axis of the shaft and to lie to the same side of the shaft to the position of the golfer.

Desirably, the head is detachably secured to the hosel whereby to allow for the provision of a number of heads for selective attachment to the shaft, for example, to suit different conditions.

With a straight hosel, the head may be adjustable along the length of the hosel to suit a golfer, but not to a distance from the shaft which is less than the diameter of the ball. Equally, and with a cranked hosel, the attachment of the top face of the head to the cranked end of the hosel may be such as to allow an adjustment of the position of the head in relation to the hosel. The position of the head affects the swing characteristics of the club, and if desired, weights may be attached to the free end of the club head.

In the circumstance where the shaft is of a length such that the free end can be held in the armpit of the user, the material of the shaft, and/or the dimensions of the shaft (diameter in particular), may be such as to provide a shaft of considerable rigidity. However, it is preferred that the shaft is of a material and a cross-sectional format that provides required rigidity. Thus, and for example, the golf club shaft may be formed from tubular plastics material.

It is further preferred, and for the convenience of the golfer, to provide a sleeve or cushion at the free end, and to provide partway along the shaft a sleeve or handgrip at a distance along the shaft commensurate with the arm length of the golfer.

An essential advantage of this aspect of the invention is that with the end of the shaft nestled in the armpit of the golfer, it constitutes the sole fulcrum about which the putter can be swung and consequently totally eliminates the vagiaries that can be introduced by the hingeing of the hands and the arms about the wrist, the elbow and the shoulder. By tailoring the length of the shaft to the golfer, the placement of the end of the shaft in the armpit and the head of the club behind the ball causes the golfer to assume the same stance on each and every occasion.

In all forms of the invention, by providing an offset hosel greater than the diameter of the ball, full advantage is taken in the benefit in having the face of the club head trailing the axis of the shaft, and a substantial elimination of any twisting moment applied to the club head as it impacts the ball. There is also the further advantage that with the club head positioned directly behind the ball, the ball is in full view. Yet another advantage is the guarantee that with the club head positioned behind a ball, there is the substantial guarantee that the hands are ahead of the ball, another important factor in achieving a correct putting stroke.

With a shaft of long length, the advantage of providing a flexible shaft is that the swinging of the club with any appreciable speed causes flexing, that transmits a force to the hands, which flexing may also be visible to the eye, and hence constitutes a major encouragement in the swinging of the club at a rate where flexing does not occur with the consequent, almost enforced, gentle and rhythmic tempo that promotes a good putting action. The disposition of the club, extending from the armpit and across the body of the golfer to the ground behind the ball provides a major control factor in the direction of swing of the club.

Whilst a shaft length tailored to suit a particular individual may be provided, the provision of a shaft of adjustable length, allows adjustment to suit the length of arm of the individual. The sleeve or hand grip partway along the shaft may also be adjustable along the length of the shaft. Further possible is the provision of a shaped hand grip to assist in correct alignment.

Further possible is an adjustable connection as between the hosel and the shaft to permit a change in angular disposition of the hosel to enable an individual to select the positioning of the golf club head.

The golf club head or heads for attachment to the hosel may be of relatively conventional shapes and materials. Equally the head may be larger than conventional heads, and be of symmetrical shape, and may be of a plastics material.

BRIEF DESCRIPTION OF THE DRAWINGS

Two embodiments of the invention will now be described in greater detail, by way of example only, with reference to the accompanying drawings, in which.

DESCRIPTION OF THE PREFERRED EMBODIMENTS

Figure 1:
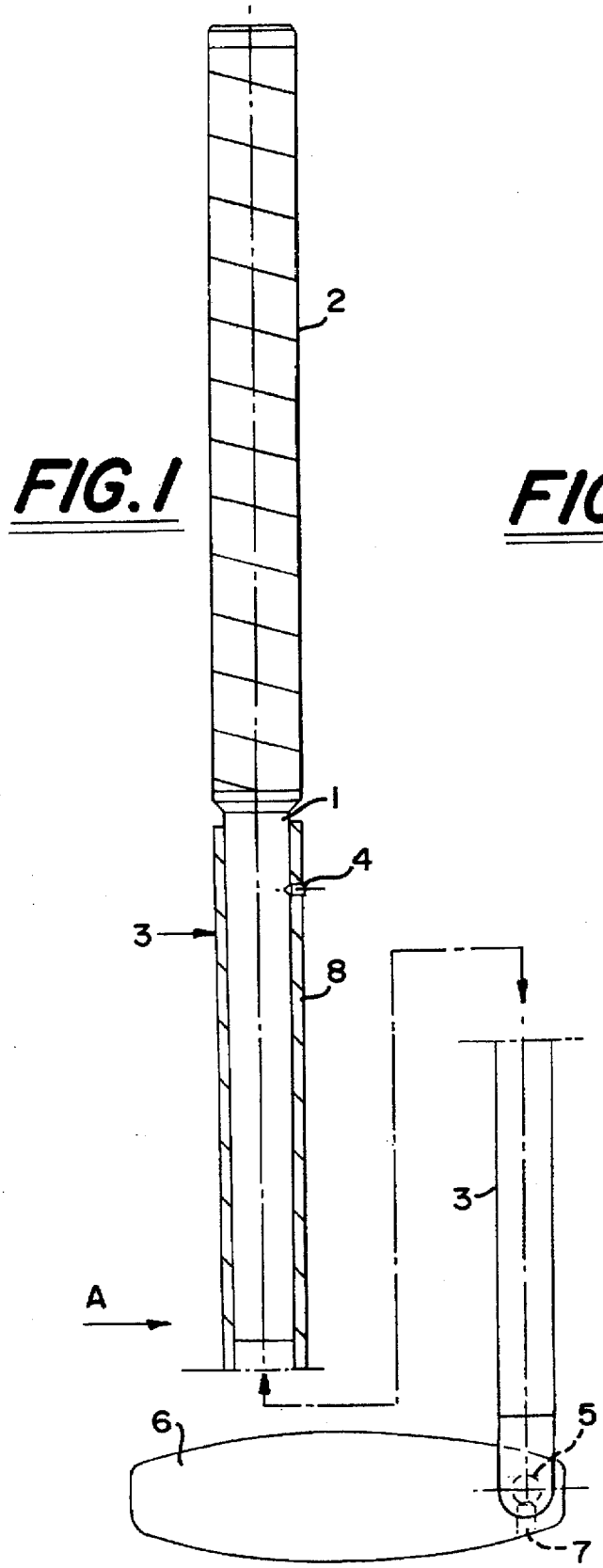
FIG. 1 is a part-sectional side elevation of one form of golf putter in accordance with the invention.
Figure 2:
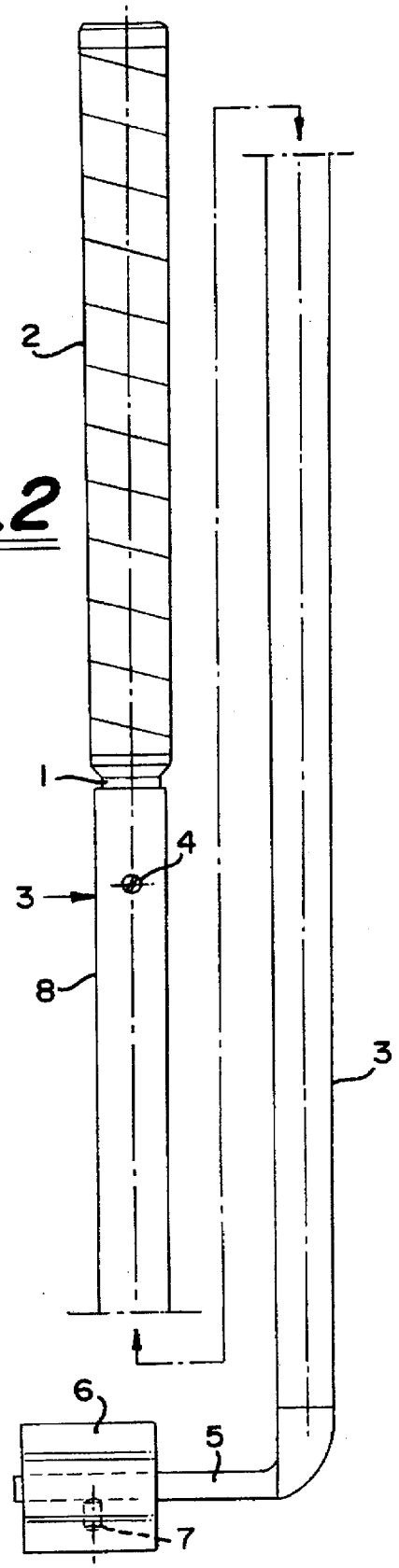
FIG. 2 is a view in the direction of arrow A of FIG. 1.

In FIGS. 1 and 2, a golf club putter comprises a shaft part 1 having a padded grip 2, the shaft part 1 being telescopically located within the end of a shaft part 3, there being a locking screw means 4 to secure the shaft part 1 to the shaft part 3 with the shaft part 1 extending to a required degree out of the shaft part 3. Here, there is provided a golf putter of a length such that with the head in proximity to the ground, the end of the padded grip 2 can be located in the armpit of the golfer, with the golfer in a generally upright position. By telescopically locating the shaft part 1 within the shaft part 3, an adjustment is provided of the total length of shaft, to enable a total shaft length to be provided to suit the height of the particular golfer.

At the lower end of the shaft part 3, there is provided a hosel 5 extending at 90° to the axis of the shaft, on which hosel is positioned a golf putter head 6. The hosel extends substantially perpendicular from the face of the head. The head 6 is mounted on the hosel 5 such that it can be pivotally adjusted whereby the golfer can select a lie of head that is suited to him, and the head is slidable along the hosel such that it can be positioned at a distance from the shaft axis to suit the golfer from a minimum equal to the diameter of a golf ball up to a maximum permitted by R & A Rules. Once the head has been set in its desired angular disposition and at a required distance from the shaft along the hosel, the head is locked to the hosel by, for example, locking screw means 7.

Desirably the shaft length 3 is hollow over its entire length and is formed from a relatively inflexible synthetic material such as, perhaps, carbon fibre or an admix of carbon fibre and boron, to provide a shaft of relatively light weight, high strength, and controlled flexibility.

Further preferably, the head 6 is of a symmetrical ovoid peripheral shape and of an appropriate synthetic plastics material, the shape, the front to back dimension, and the material combining to provide a head that is devoid of a sweet spot at a particular location on the head.

An advantage of this form of construction is that, in addition to the ability of the club to be tailored to suit a particular golfer, the club is readily adaptable for use either left-hand or right-hand, simply by releasing the locking screw 7 and rotating the head through approximately 180° before relocking the head to the hosel.

A further advantage of this form of construction is that the shaft part 1 can be removed to leave the shaft part 3 on which the head 6 is mounted, for use after the manner of a golf club putter of conventional length, padding for the comfort of the user being provided on the shaft part 3 as is indicated at 8.

Figure 3:
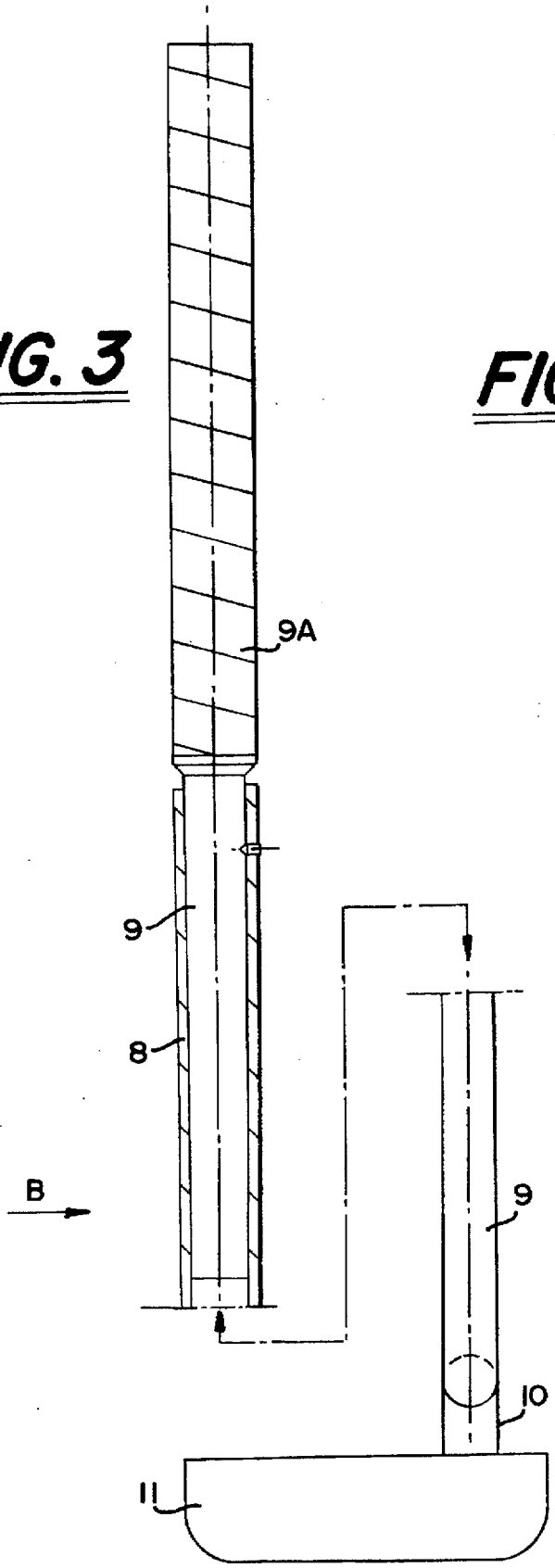
FIG. 3 is a side elevation of a second form of golf putter in accordance with the invention.
Figure 4:
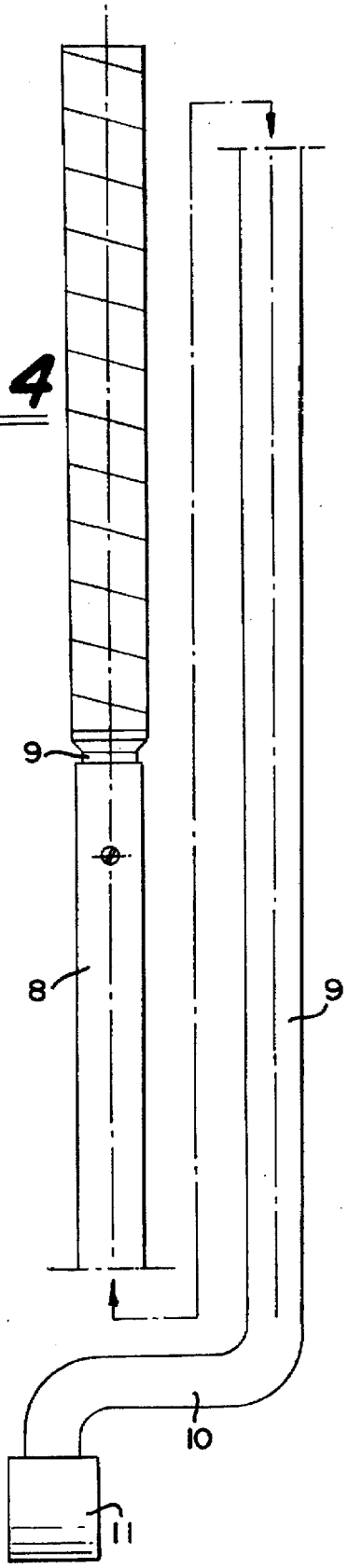
FIG. 4 is a view in the direction of arrow of B of FIG. 3.

In the second form of construction shown in FIGS. 3 and 4, here a one-piece shaft 9 is provided having a padded section 9A extending from the free end to a position on the shaft such that with the free end located in the armpit, the padded section extends to a location where it can be comfortably gripped by the hands of the user. At the lower end of the shaft 9 an offset and cranked hosel 10 is provided to which a golf putter head 11 is attached, the offset hosel being of a length such that the strike face of the putter head 11 is at a distance from the axis of the shaft at a minimum of the diameter of a golf ball up to the maximum allowed by R & A Rules. Here again, there is a desirability in forming the shaft 9 of such as a carbon or carbon boron material to provide high strength and light weight and predeterminable flexibility.

I claim:

1. A golf club comprising a shaft having a longitudinal axis an offset hosel on the shaft, and the head securable on the offset hosel, wherein the head is slidably adjustable along at least a portion of the hosel to a selected distance from the longitudinal axis of the shaft such that the head is securably connected at each distance from the shaft.

2. A golf club as in claim 1, wherein the hosel is straight and lies at 90° to the axis of the shaft the hosel extending substantially perpendicular from a face of the head.

3. A golf club as in claim 1, wherein the hosel is cranked.

4. A golf club as in any of claims 1 to 3, wherein the head is adjustably secured to the hosel, and a locking means is provided to lock the head to the hosel.

5. A golf club as in any of claims 1 to 3, wherein the length of the shaft is relatively conventional or is of a length such that with the head of the club in proximity to the ground, the free end of the shaft can be gripped in the armpit of the golfer.

6. A golf club as in claim 5, wherein the shaft is adjustable in length to suit the stature of a golfer.

7. A golf club as in claim 5, wherein the shaft is a two-part shaft with a first, relatively conventional length to enable relatively conventional use, and an extension piece able to be attached to the first length to provide a free end able to be gripped in the armpit of the user.

8. A golf club as in any of claims 1 to 3, wherein the head is angularly adjustable on the hosel.

9. A golf club as in any of claims 1 to 3, wherein the head is rotatable on the hosel through 180° to provide for right-hand and left-hand use.

10. A golf club as in any of claims 1 to 3, wherein the head is adjustable along the length of the hosel to a position not nearer the axis of the shaft than the diameter of a ball.

11. A golf club as in any of claims 1 to 3, wherein the shaft is of a predetermined degree of rigidity.

12. A golf club as in any of claims 1 to 3, wherein the shaft may be of an plastics/carbon fibre material.

13. A golf club as in any of claims 1 to 3, wherein the golf club head is of an plastics material and of a symmetrical configuration.

14. A golf club as in any of claims 1 to 3, wherein the head is strikeable against a ball having a diameter, and wherein the head is slidably adjustable to a distance from the longitudinal axis of the shaft, wherein the distance is greater than the diameter of the ball.

15. A golf club comprising a shaft of a length commensurate with a height of a golfer and whereby a free end of the golf club shaft can be gripped in an armpit of the golfer and the club head positioned behind a ball with the golfer in a generally upright disposition, the connection between the golf club head and the shaft being by way of an offset hosel, the length and height of which is greater than the diameter of the ball, the hosel extending substantially perpendicular from a face of the head, and the golf club head being slidably adjustably secured to the hosel.

* * * * *